US006527084B2

(12) United States Patent
Hrincu

(10) Patent No.: US 6,527,084 B2
(45) Date of Patent: Mar. 4, 2003

(54) LADDER STABILIZER

(76) Inventor: Viorel Hrincu, P.O. Box 8, Chipman, Alberta (CA), T0B 0W0

( * ) Notice: Subject to any disclaimer, the term of this patent is extended or adjusted under 35 U.S.C. 154(b) by 0 days.

(21) Appl. No.: 09/978,390

(22) Filed: Oct. 16, 2001

(65) Prior Publication Data

US 2002/0056591 A1 May 16, 2002

(30) Foreign Application Priority Data

Nov. 16, 2000 (CA) ..... 2326016

(51) Int. Cl.[7] ..... E06C 1/00
(52) U.S. Cl. ..... 182/172; 182/180.2
(58) Field of Search ..... 182/172, 107, 182/108, 180.2, 180.3, 22, 200

(56) References Cited

U.S. PATENT DOCUMENTS

| | | | | |
|---|---|---|---|---|
| 2,868,427 A | * | 1/1959 | Hess | |
| 4,565,262 A | * | 1/1986 | Hawkins | |
| 4,872,529 A | | 10/1989 | Viets | 182/172 |
| 4,899,849 A | | 2/1990 | Levi et al. | 182/172 |
| 4,924,971 A | * | 5/1990 | Rice | |
| 4,949,809 A | | 8/1990 | Levi et al. | 182/172 |
| 4,971,167 A | | 11/1990 | Winnard | 182/107 |
| 5,165,501 A | * | 11/1992 | Donahey | |
| 5,857,544 A | | 1/1999 | Del Sole | 182/180.3 |
| 5,868,222 A | | 2/1999 | Charbonneau | 182/172 |
| 6,019,191 A | * | 2/2000 | Flores | |

FOREIGN PATENT DOCUMENTS

| | | | | |
|---|---|---|---|---|
| AU | 165 920 | * | 1/1955 | 182/107 |
| GB | 2146 688 | * | 4/1985 | |
| WO | 8302796 | * | 8/1983 | 182/107 |

* cited by examiner

*Primary Examiner*—Alvin Chin-Shue
(74) *Attorney, Agent, or Firm*—David & Bujold, P.L.L.C.

(57) ABSTRACT

A ladder stabilizer includes a substantially planar rigid frame having two legs depending in spaced apart relation with a fixed angular relationship to the frame. The frame has a first end and a second end, with remote ends of the two legs defining the second end. A pivot bar is provided which is secured to a selected rung of a ladder. Pivot bar retention brackets are secured to the frame in spaced relation adjacent to the first end. The ladder stabilizer described can be attached to a ladder without drilling bolt apertures.

8 Claims, 7 Drawing Sheets

LADDER STABILIZER

FIELD OF THE INVENTION

The present invention relates to a ladder stabilizer for an extension ladder.

BACKGROUND OF THE INVENTION

U.S. Pat. No. 4,899,849 (Levi et al) discloses a ladder stabilizer that has two stabilizing legs and two braces. Each of the stabilizing legs and each of the braces are pivotally secured to a ladder by means of a bracket. The bracket is fastened to opposed side rails of the ladder by bolts which are inserted through apertures drilled through the side rails.

While ladder stabilizers, such as those disclosed by Levi et al, appear to greatly enhance the stability of a ladder, they all have one basic problem. The laws of many legal jurisdictions require that ladders be certified by qualified engineers as being capable of supporting anticipated loads. Apertures drilled through the side rails of a ladder void such certification, due to the fact that such apertures may adversely affect the ladder's load bearing capability.

SUMMARY OF THE INVENTION

What is required is an alternative configuration of ladder stabilizer that is securable to a ladder without drilling apertures through the ladder.

According to the present invention there is provided a ladder stabilizer which includes a substantially planar rigid frame having two legs depending in spaced apart relation with a fixed angular relationship to the frame. The frame has a first end and a second end, with remote ends of the two legs defining the second end. A pivot bar is provided, together with means for securing the pivot bar to a selected rung of a ladder. Pivot bar retention brackets are secured to the frame in spaced relation adjacent to the first end. Means is provided for limiting pivotal movement of the frame about the pivot bar.

With the ladder stabilizer, as described above, the legs of the stabilizer are rigidly fixed to and form part of a frame, with the frame pivoting about a pivot bar that extends through one of the hollow rungs of the ladder. This enables the ladder stabilizer to be secured in position, without drilling apertures through the ladder. As the ladder has a plurality of rungs along its length, the ladder stabilizer can be adapted to accommodate stairs, and other demanding applications by varying the rung through which the pivot bar extends.

There are various means that can be used to limit the pivotable movement of the frame about the pivot bar to prevent an unintended collapse of the legs. In the preferred embodiment, which will hereinafter be further described, two limiting means are used. A first means for limiting pivotal movement of the frame about the pivot bar is a line extending from each of the remote ends of the legs, which is securable to the ladder. A second means for limiting pivotable movement of the frame about the pivot bar is a pivotal stop extending from the frame and adapted to engage the ladder upon pivotal movement of the frame.

Although beneficial results may be obtained through the use of the ladder stabilizer, as described above, if the pivot bar were to become displaced, the ladder stabilizer could collapse. Even more beneficial results may, therefore, be obtained, when a line extends from each end of the pivot bar, which is securable to the ladder to limit axial movement of the pivot bar.

BRIEF DESCRIPTION OF THE DRAWINGS

These arid other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
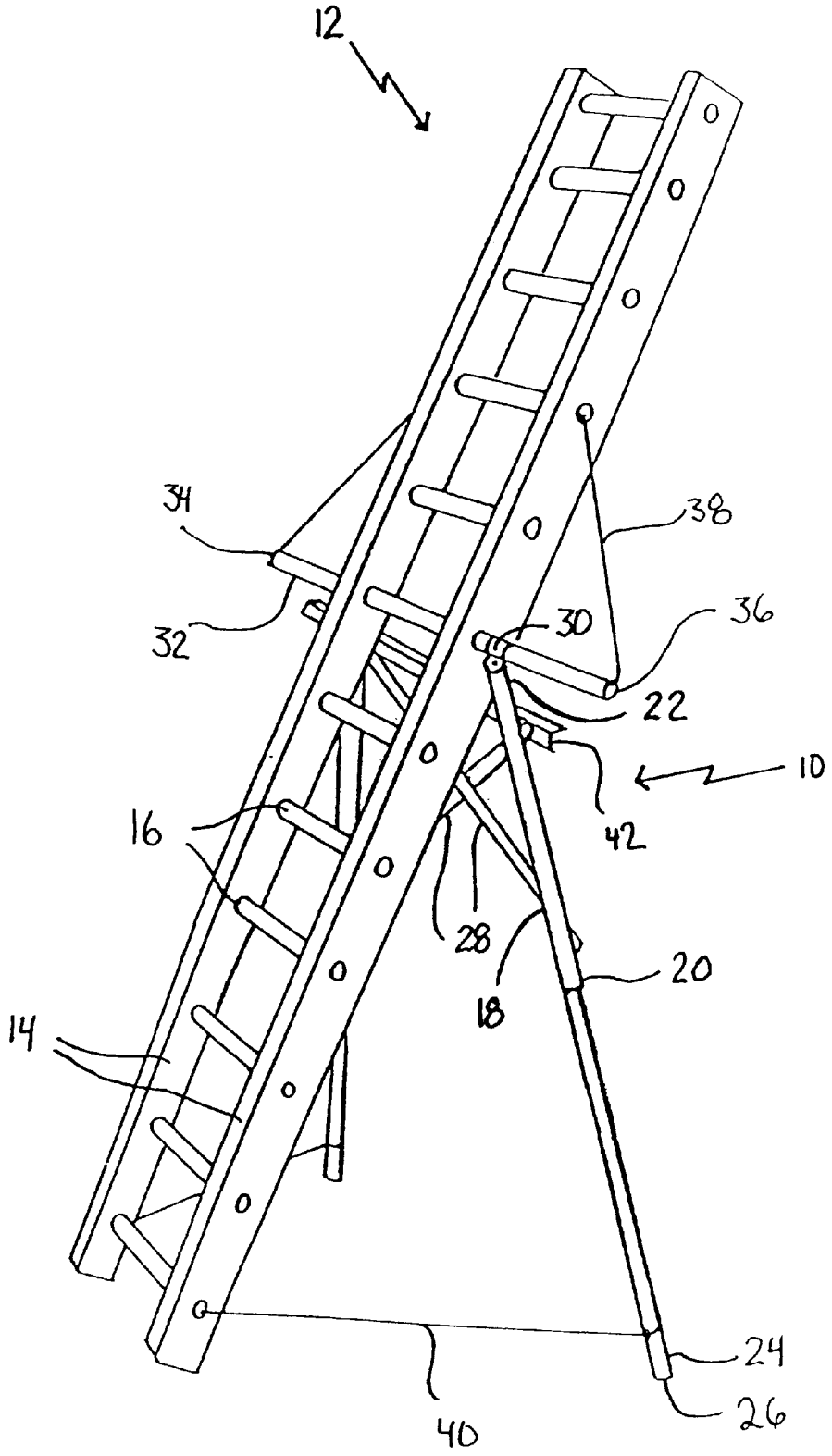
FIG. 1 is a perspective view of a ladder stabilizer constructed in accordance with the teachings of the present invention attached to a ladder.

The preferred embodiment, a ladder stabilizer generally identified by reference numeral 10, will now be described with reference to FIGS. 1 through 7.

Figure 3:
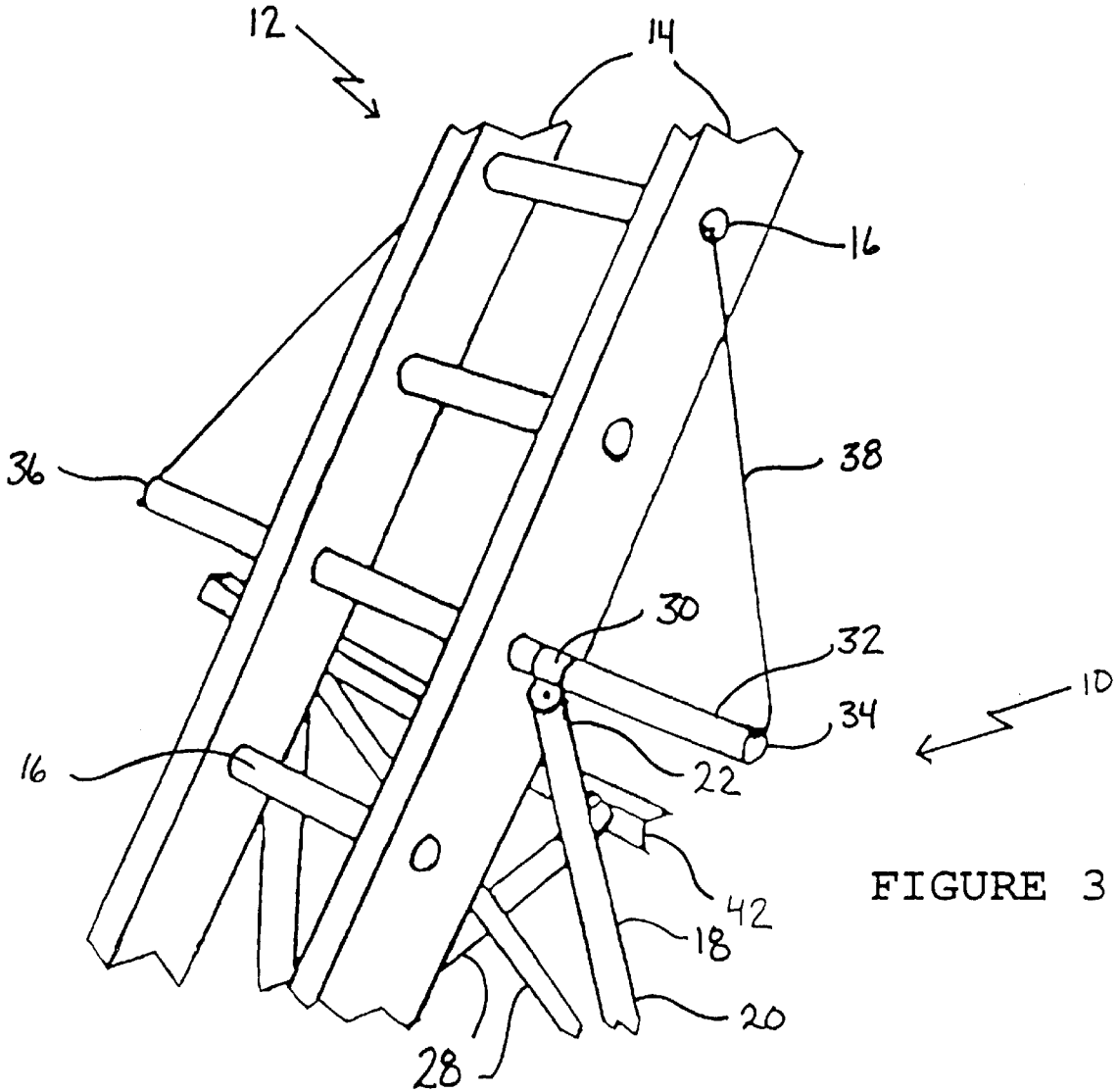
FIG. 3 is a perspective view of the ladder with ladder stabilizer illustrated in FIG. 1, with the first safety line engaged to limit movement of the pivot bar.
Figure 4:
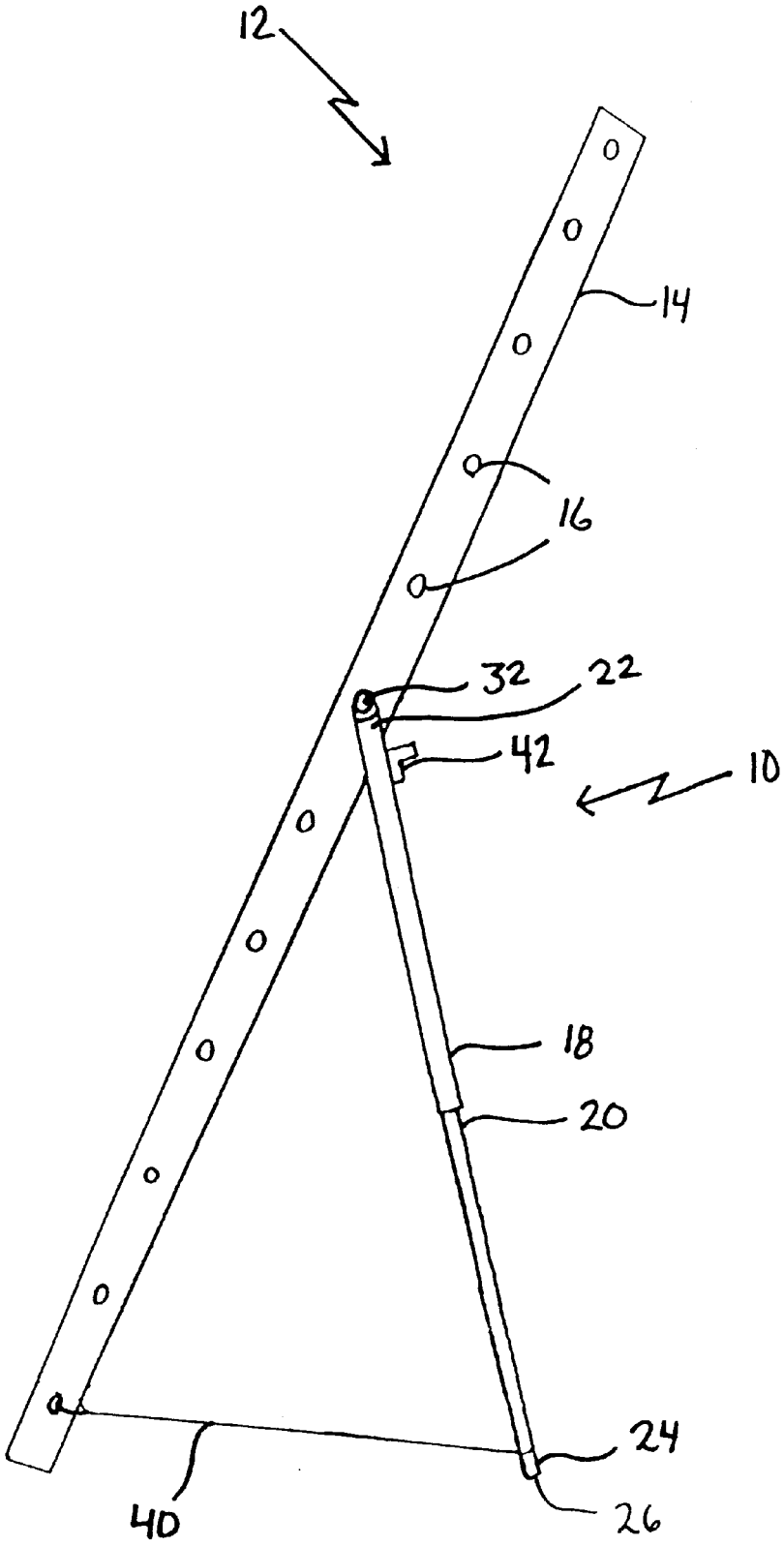
FIG. 4 is a side elevation view of the ladder with ladder stabilizer illustrated in FIG. 1, with the second safety line engaged to limit movement of the ladder stabilizer frame.

Structure and Relationship of Parts:

Referring to FIG. 1 there is provided an aluminum ladder generally referenced by reference numeral 12 which has a pair of spaced side rails 14 and a plurality of hollow rungs 16 that extend between side rails 14. Attached to aluminum ladder 12 is a ladder stabilizer 10 that includes a substantially planar rigid frame 18 with two legs 20 that depend in spaced apart relation in a fixed angular relationship to frame 18. Frame 18 has a first end 22 and a second end 24 with remote ends 26 of two legs 20 defining second end 24 of frame 18. Two crossed support members 28 extend between legs 20 toward first end 22 of frame 18 to maintain the rigid condition of frame 18. Referring to FIG. 3, pivot bar retention brackets 30 are secured to frame 18 in spaced relation at a position adjacent to first end 22 of frame 18. Pivot bar 32 is inserted through one of hollow rungs 16 of ladder 12 and engages retention brackets 30. Pivot bar 32 has a first end 34 and a second end 36. A first line 38 is secured to first end 34 and second end 36 of pivot bar 32 and extends through another of hollow rungs 16 of ladder 12, thereby limiting axial movement of pivot bar 32 relative to ladder 12. Referring to FIG. 4, a second line 40 extends from each of remote ends 26 of legs 20 and through yet another of hollow rungs 16 of ladder 12, thereby limiting pivotal movement of frame 18 about pivot bar 32. First line 38 and second line 40 can be cords, chains, wire, or similar materials. There are alternative methods to affix first line 38 and second line 40 to hollow rungs 16. Rather than extending through hollow rungs 16, first line 38 and second line 40 could be looped around hollow rungs 16, or looped around side rails 14.

Figure 5:
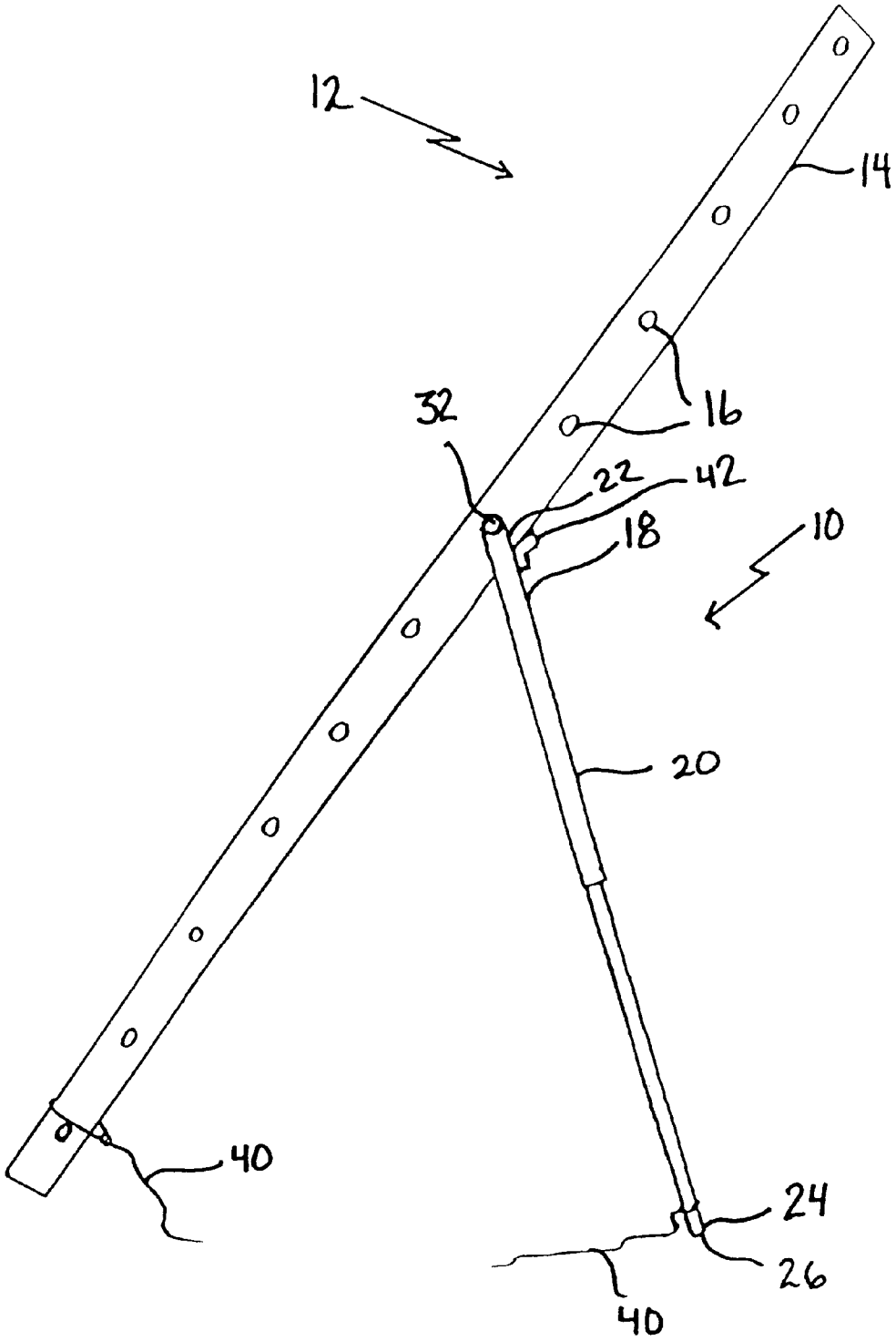
FIG. 5 is a side elevation view of the ladder with ladder stabilizer illustrated in FIG. 1, with the pivotal stop engaged to limit movement of the ladder stabilizer frame.

Referring to FIG. 5, a pivotal stop 42 extends from frame 18 and is adapted to engage ladder 12 upon pivotal movement of frame 18, thereby limiting pivotal movement of frame 18 should second line 40 break.

Operation:

The use and operation of ladder stabilizer 10, will now be described with reference to FIGS. 1 through 6. Referring to FIG. 1, where ladder 12 is required to be free standing during use or requires additional stability, ladder stabilizer 10 may be used. Ladder 12 is first transported to the desired location Referring to FIG. 3, ladder stabilizer 10 is then affixed to ladder 12 by sliding pivot bar 32 through one of hollow rungs 16 on ladder 12. Pivot bar 32 is able to pivot within hollow rung 16 for adjustment of the positioning of legs 20 of frame 18 relative to side rails 14 of ladder 12. Next, pivot bar retention brackets 30 which encircle pivot bar 32 are used to secure first end 22 of frame 18 to pivot bar 32 thereby eliminating the need to make any alterations to ladder 12 itself. To prevent axial movement of pivot bar 32, first line 38 is attached to first end 34 of pivot bar 32, then inserted through another of hollow rungs 16 on ladder 12 before being secured to second end 36 of pivot bar 32. Referring to FIG. 4, remote ends 26 of legs 20 of ladder stabilizer 10 are then placed at an appropriate distance relative to side rails 14 of ladder 12. Second line 40 is then attached to one of remote ends 26 of legs 20 and fed through yet another of hollow rungs 16 of ladder 12 before being attached to remote end 26 of other leg 20. Second line 40 restricts movement of legs 20 so that legs 20 do not inadvertently slip further away from side rails 14 of ladder 12 thereby causing ladder 12 to collapse. Second line 40 can be adjusted in length to accommodate various positioning of legs 20 relative to ladder 12. Referring to FIG. 5, in the event that second line 40 breaks, pivot stop 42 on frame 18 will pivot along with pivot bar 32 until pivot stop 42 braces against side rails 14 of ladder 12, thereby preventing ladder 12 and ladder stabilizer 10 from collapsing.

Figure 2:
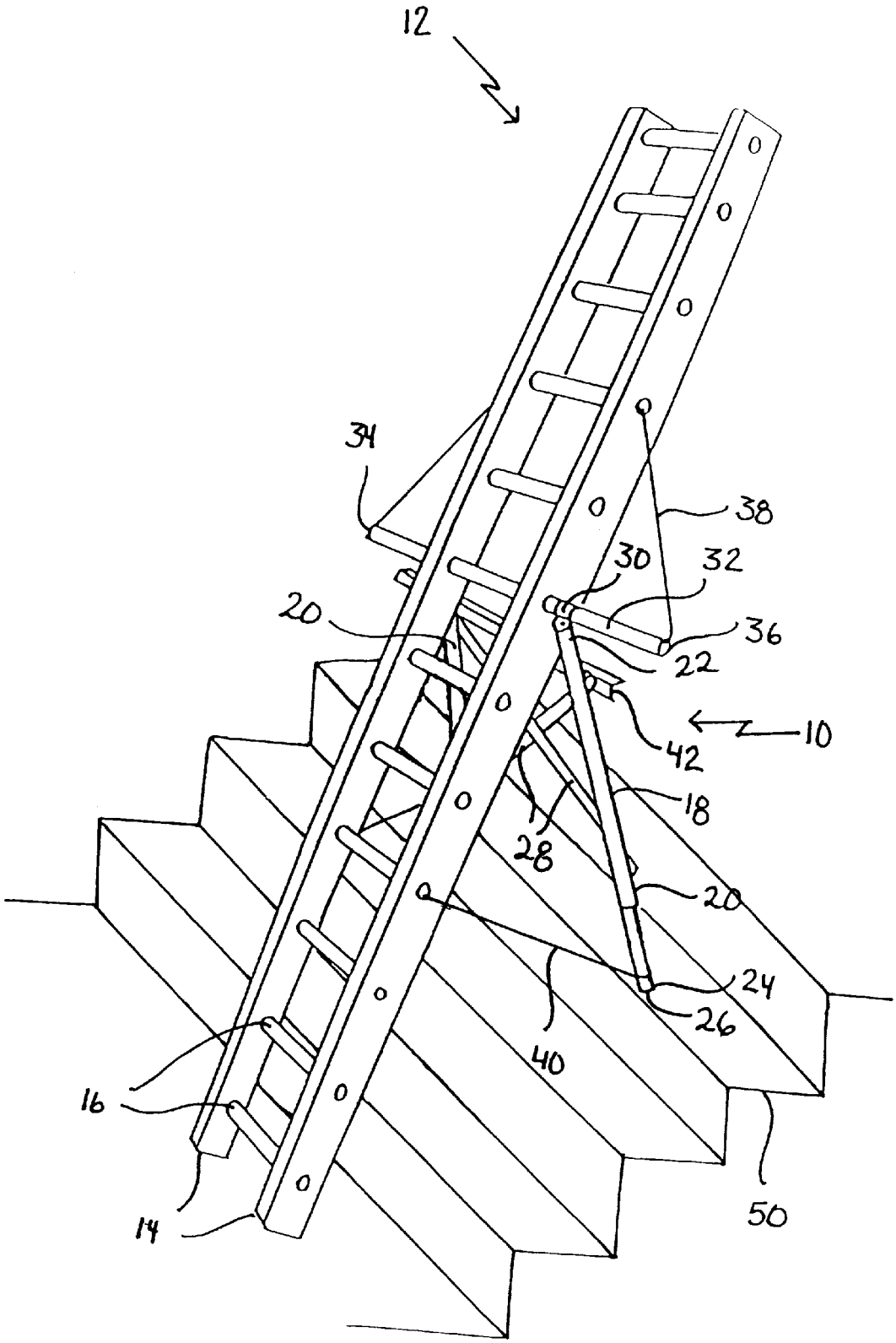
FIG. 2 is a perspective view of the ladder with ladder stabilizer illustrated in FIG. 1, in use on stairs.
Figure 6:
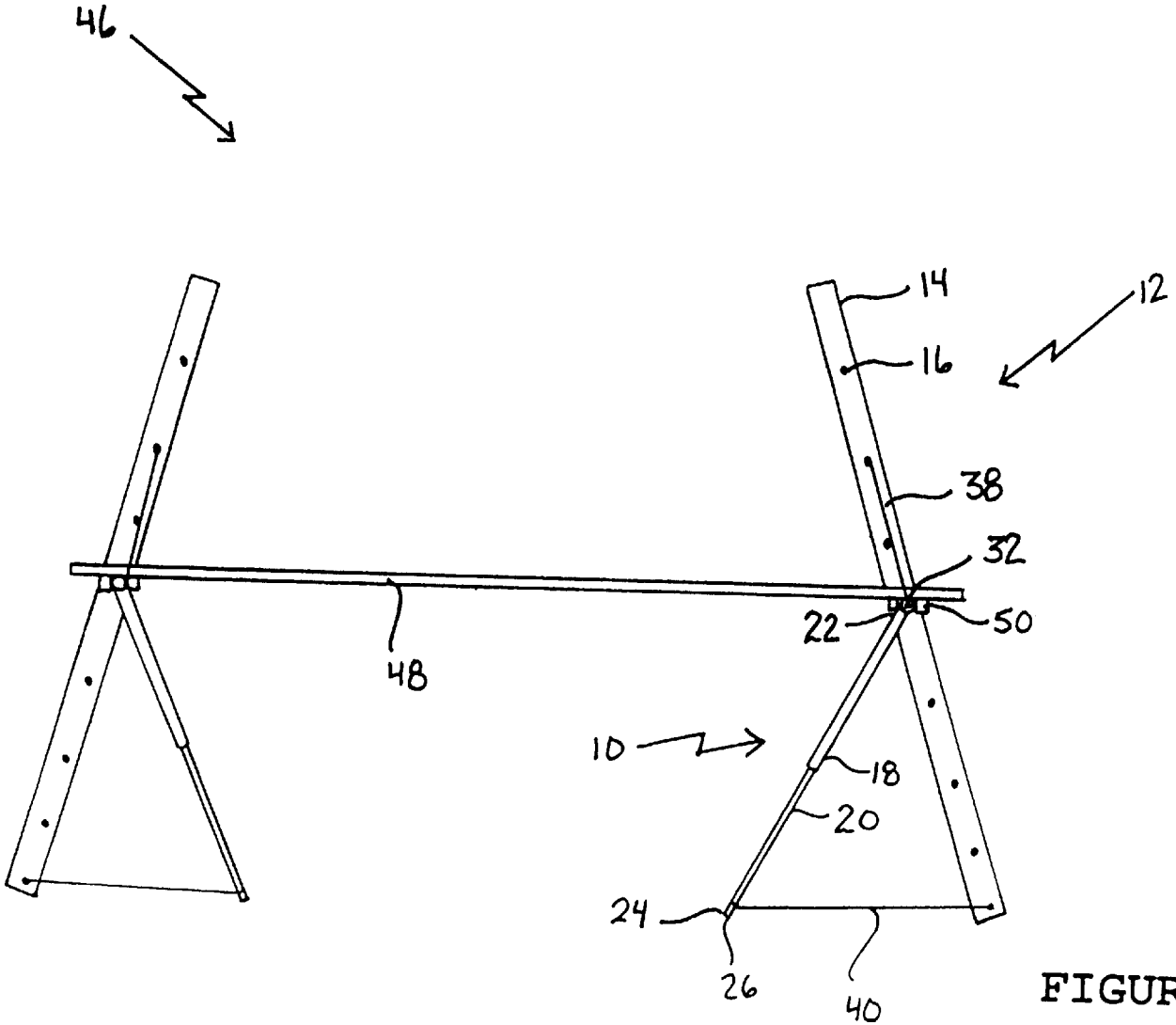
FIG. 6 is a side elevation view of two ladders with ladder stabilizers illustrated in FIG. 1, arranged with planking to provide a working platform.

Referring to FIG. 1, when used with ladder stabilizer 10, ladder 12 may be used as a free standing ladder 12 in situations where there is no support against which to lean ladder 12. Referring to FIG. 2, ladder stabilizer 10 can be used to stabilize ladder 12 when ladder 12 is erected along a set of steps 44. Pivot bar 32 is placed though hollow rung 16 which best suits the positioning of legs 20 along steps 44. Further more, second line 40 is inserted through hollow rung 16 which corresponds in height to step 44 on which legs 20 are placed. Referring to FIG. 6, two ladders 12 with stabilizers 10 can be also be used to form a scaffold generally referenced by numeral 46. In order to form scaffold 16, two ladders 12 with attached ladder stabilizers 10 are placed in alignment and spaced apart from each other. A plank 48 is placed so that plank 48 extends between and is supported by pivot bar 32 of each of ladder stabilizers 10. Preferably planks 48 will have stops 50 which engage with pivot bars 32 to prevent movement of plank 48. Each first line 38 will assist in preventing plank 48 from sliding sideways off of pivot bars 32 while a user is standing on plank 48. To change the height of scaffold 46, pivot bar 32 and plank 48 can be placed in varying hollow rungs 16.

Figure 7:
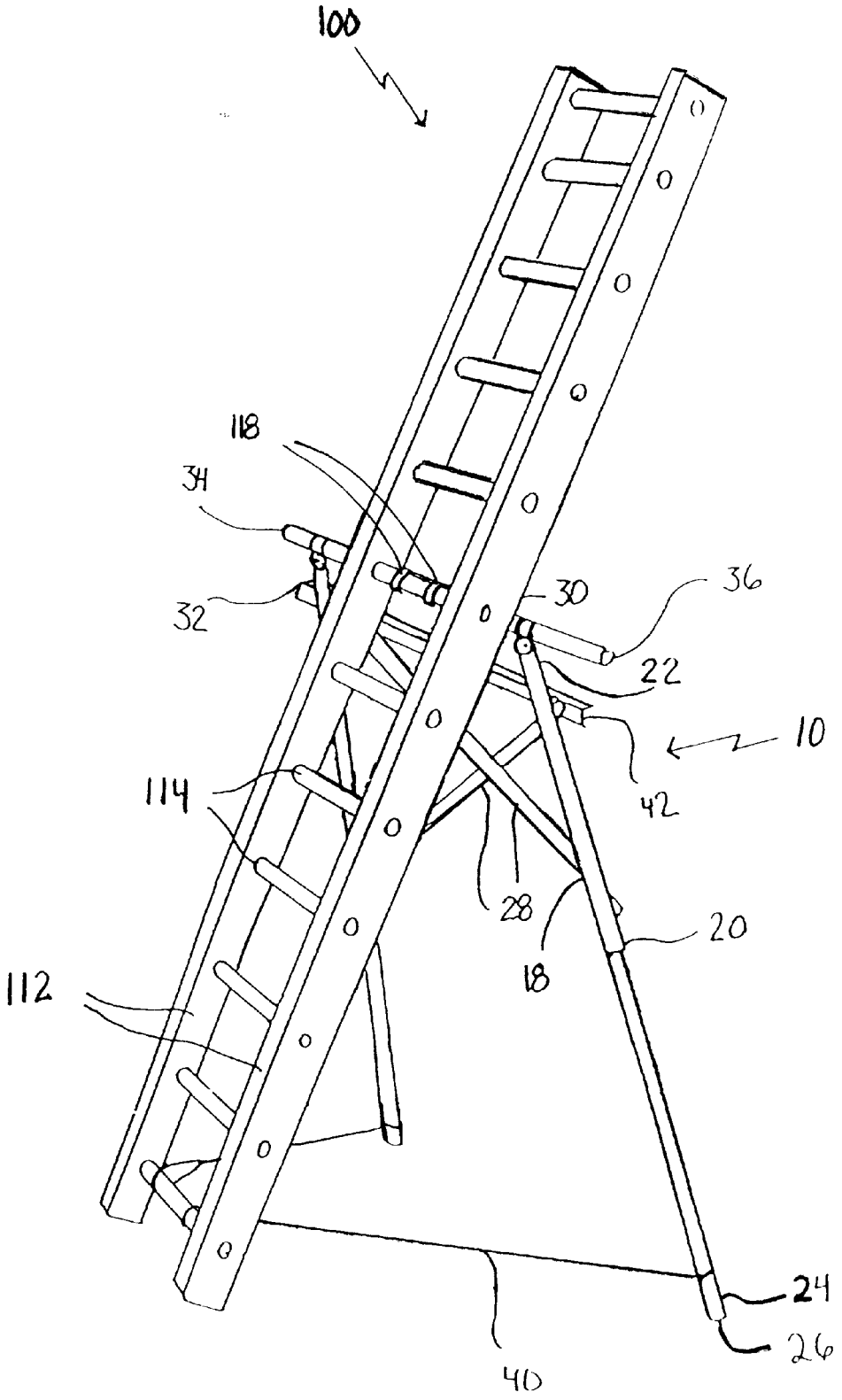
FIG. 7 is a perspective view of the ladder stabilizer illustrated in FIG. 1, showing an alternative mode of attaching the ladder stabilizer to a ladder.

Variations and Alternative Embodiments:

Referring to FIG. 7, ladder stabilizer 10 can also be used with a ladder that does not have hollow rungs 16. A wooden ladder generally reference by numeral 100 for instance has two wooden side rails 112 with a plurality of solid rungs 114 that extend between side rails 112. Where wooden ladder 100 is required to be free standing during use or requires additional stability, ladder stabilizer 10 may be used although ladder stabilizer 10 is affixed to wooden ladder 100 in a different manner than as described for aluminum ladder 12. With wooden ladder 100, pivot bar 32 cannot be slide through solid rungs 114, rather pivot bar 32 is affixed to a selected one of solid rung 114 by means of brackets 118. Pivot bar 32 is still able to pivot within brackets 118 for adjustment of the positioning of legs 20 of frame 18 relative to side rails 112 of wooden ladder 100. First line 38 is not necessary as brackets 118 prevent axial movement of pivot bar 32. Once legs 20 of frame 18 have been properly positioned relative to side rails 112, second lines 40 are then attached to remote ends 26 of legs 20 and then secured to a select one of solid rungs 114 of wooden ladder 100 to prevent inadvertent movement of legs 20 away from wooden ladder 100. In the event that second line 40 breaks, pivot stop 42 on frame is still able to pivot along with pivot bar 32 until pivot stop 42 braces against side rails 112 of wooden ladder 100, thereby preventing ladder 100 and ladder stabilizer 10 from collapsing.

The illustrated embodiments have legs of a fixed length. This is preferred, as there is never a concern about one of the legs collapsing. If, however, ladder stabilizer 10 was continually being used on uneven ground, extendible legs may be required in order adjust the legs to be of unequal length. Extendible legs are well known in the prior art and will, therefore, not be further described.

Cautionary Warnings:

Care must be taken in the positioning of ladder stabilizer 10 on ladder 12. Ladder 12 can tip forward if ladder stabilizer 10 is positioned low and a person is standing at the highest point of ladder 12. This does not pose a great danger if ladder 12 is up against a wall, for the forward tipping action of ladder 12 will be impeded by the wall. However, when ladder 12 is used as a stand alone unit, care must be taken with this overbalancing condition.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A ladder stabilizer, comprising:

a substantially planar rigid frame having two legs depending in spaced apart relation, the frame having a first end and a second end, with remote ends of the two legs defining the second end;

a pivot bar;

pivot bar retention brackets adapted to receive the pivot bar secured in spaced relation to the frame adjacent to the first end, the pivot bar retention bracket allowing the frame to pivot freely on the pivot bar;

means for securing the pivot bar to a selected rung of a ladder;

a line extending from each of the remote ends of the legs, the line being securable to the ladder, thereby limiting pivotal movement of the frame about the pivot bar away from the ladder; and a pivotal stop extending outwardly from the first end of the frame adjacent to the pivot bar and adapted to engage the ladder upon pivotal movement of the frame away from the ladder, thereby limiting pivotal movement of the frame about the pivot bar should the line break.

2. The ladder stabilizer as defined in claim 1, wherein the ladder has hollow rungs and the mean, for securing the pivot bar to a selected rung of a ladder is by extending the pivot bar through a selected one of the hollow rungs.

3. The ladder stabilizer as defined in claim 1, wherein the means for securing the pivot bar to a selected rung of a ladder is by clamping the pivot bar to the selected rung with attachment brackets.

4. The ladder stabilizer as defined in claim 2, wherein a line extends from each end of the pivot bar through a second selected one of the plurality of hollow runs of the ladder, thereby limiting axial movement of the pivot bar.

5. A ladder stabilizer, comprising:

a substantially planar rigid frame having two legs depending in spaced apart relation with a fixed angular relationship to the frame, the frame having a first end and a second end, with remote ends of the two legs defining the second end, the legs having a fixed angular relationship which diverges from the first end toward the second end;

a pivot bar adapted for insertion through a first one of a plurality of hollow rungs of a ladder;

a pivot bar retention bracket secured to the frame and positioned adjacent to the first end, the pivot bar retention bracket allowing the frame to pivot freely on the pivot bar;

a first line extending from each end of the pivot bar, the first line being adapted to extend through a second selected one of the plurality of hollow rungs of the ladder, thereby limiting axial movement of the pivot bar relative to the ladder;

a second line extending from each of the remote ends of the legs, the second line being securable to the ladder thereby limiting pivotal movement of the frame about the pivot bar away from the ladder; and a pivotal stop extending outwardly from the first end of the frame and adapted to engage the ladder upon pivotal movement of the frame away from the ladder, thereby limiting pivotal movement of the frame should the second line break.

6. A ladder stabilizer, comprising:

a substantially planar rigid frame having two legs depending in spaced apart relation, the frame having a first end and a second end, with remote ends of the two legs defining the second end, the legs having a fixed angular relationship which diverges from the first end toward the second end;

a pivot bar;

clamps adapted for clamping the pivot bar to a rung of a ladder;

a pivot bar retention bracket secured to the frame and positioned adjacent to the first end, the pivot bar retention bracket allowing the frame to pivot freely on the pivot bar;

a line extending from each of the remote ends of the legs, the line being securable to the ladder thereby limiting pivotal movement of the frame about the pivot bar away from the ladder; and a pivotal stop extending outwardly from the first end of the frame and adapted to engage the ladder upon pivotal movement of the frame away from the ladder, thereby limiting pivotal movement of the frame should the line break.

7. A ladder stabilizer/ladder combination, comprising:

a ladder having a pair of spaced side rails and a plurality of hollow rungs that extend between the side rails;

a ladder stabilizer having a substantially planar rigid frame with two legs depending in spaced apart relation, the frame having a first end and a second end, with remote ends of the two legs defining the second end, the legs having a fixed angular relationship which diverges from the first end toward the second end;

pivot bar retention brackets secured to the frame in spaced relation at a position adjacent to the first end;

a pivot bar inserted through a first selected one of the plurality of hollow rungs of the ladder and engaging the retention brackets, the pivot bar retention bracket allowing the frame to pivot freely on the pivot bar;

a first line secured to each end of the pivot bar and extending through a second selected one of the plurality of hollow runs of the ladder, thereby limiting axial movement of the pivot bar relative to the ladder;

a second line extending from each of the remote ends of the legs, the second line extending through a third selected one of the plurality of hollow rungs of the ladder, thereby limiting pivotal movement of the frame about the pivot bar away from the ladder; and a pivotal stop extending outwardly from the first end of the frame and adapted to engage the ladder upon pivotal movement of the frame away from the ladder, thereby limiting pivotal movement of the frame should the second line break.

8. A ladder stabilizer/ladder combination, comprising:

a ladder having a pair of spaced side rails and a plurality of rungs that extend between the side rails;

a ladder stabilizer having a substantially planar rigid frame with two legs depending in spaced apart relation, the frame having a first end and a second end, with remote ends of the two legs defining the second end, the legs having a fixed angular relationship which diverges from the first end toward the second end;

pivot bar retention brackets secured to the frame in spaced relation at a position adjacent to the first end;

a pivot bar clamped by clamps to a first selected one of the plurality of rungs of the ladder and engaging the retention brackets, the pivot bar retention bracket allowing the frame to pivot freely on the pivot bar;

a line extending from each of the remote ends of the legs and secured to the ladder, thereby limiting pivotal movement of the frame about the pivot bar away from the ladder; and a pivotal stop extending outwardly from the first end of the frame and adapted to engage the ladder upon pivotal movement of the frame away from the ladder, thereby limiting pivotal movement of the frame should the line break.

* * * * *